US005148878A

United States Patent [19]

Schmidt et al.

[11] Patent Number: 5,148,878

[45] Date of Patent: Sep. 22, 1992

[54] RAM BORING MACHINE

[75] Inventors: Paul Schmidt; Alfons Hesse, both of Lennestadt; Gerhard Balve, Lennestadt-Oberelspe; Franz-Josef Püttmann, Lennestadt-Saalhausen, all of Fed. Rep. of Germany

[73] Assignee: Dipl.-Ing. Paul Schmidt, Lennestadt, Fed. Rep. of Germany

[21] Appl. No.: 473,611

[22] Filed: Feb. 1, 1990

[30] Foreign Application Priority Data

Mar. 23, 1989 [DE] Fed. Rep. of Germany ..... 3909567

[51] Int. Cl.[5] ..... E21B 4/14

[52] U.S. Cl. ..... 175/296; 173/91

[58] Field of Search ..... 175/296, 19; 173/91, 173/138

[56] References Cited

U.S. PATENT DOCUMENTS

| | | | |
|---|---|---|---|
| 4,078,619 | 3/1978 | Sudnishnikov et al. | 173/91 |
| 4,295,533 | 10/1981 | Schmidt | 173/91 |
| 4,537,265 | 8/1985 | Cox et al. | 175/296 |
| 4,662,457 | 5/1987 | Bouplon | 173/91 |
| 4,683,960 | 8/1987 | Kostylev et al. | 173/91 |
| 4,819,741 | 4/1989 | Terskov et al. | 173/91 |
| 4,840,237 | 6/1989 | Roemer | 173/91 |

FOREIGN PATENT DOCUMENTS

| | | |
|---|---|---|
| 0273139 | 7/1988 | European Pat. Off. . |
| 3315132 | 10/1984 | Fed. Rep. of Germany . |
| 636407 | 5/1983 | Switzerland . |
| 2141162 | 12/1984 | United Kingdom . |

*Primary Examiner*—Stephen J. Novosad
*Attorney, Agent, or Firm*—Akoo-Toren

[57] ABSTRACT

A ram boring machine having a striking piston that is axially displaceable in a housing, of which the forward and backward movement is controlled by a control sleeve connected to a supply hose and which engages in a cylinder chamber of the striking piston, and by one or more corresponding control openings in the striking piston, wherein the control sleeve is loaded both axially and torsionally, has axial and rotational stops and is rotatable and axially displaceable in a guide sleeve arranged at the rear end of the housing.

10 Claims, 3 Drawing Sheets

RAM BORING MACHINE

TECHNICAL FIELD OF THE INVENTION

The invention relates to a ram boring machine having a striking piston that is axially displaceable in a housing and whose forward and backward movement is controlled by a control sleeve that engages in a cylinder chamber of the striking piston and is connected to a supply hose and by one or more corresponding control openings in the striking piston.

BACKGROUND OF THE INVENTION AND PRIOR ART

Such a ram boring machine is described in German patent specification 23 40 751. In this ram boring machine the control sleeve passes through a guide member fixed to the housing, and during operation stops on the guide member and the control sleeve effect axial arresting. The control sleeve has a rotation arresting device that can be unlocked easily from outside: by rotating the control sleeve the stop or stops of the guide member or the control sleeve are brought into axial alignment with one or more longitudinal recesses in the control sleeve or in the guide member so that the control sleeve can be axially displaced. For reversing it is necessary first to disengage the rotation securing device, for example by tension on a cord carried with it, and then positively rotate the control sleeve relative to the guide member, then displace it and finally arrest it again.

In operation, it has been found that this ram boring machine, particularly when driven far into the ground, can only be reversed with difficulty from backward to forward movement. Thus by means of the supply hose the control sleeve must be pushed in a pressureless state the entire length of the earth bore into the forward position. This has proved difficult to do, particularly if, in the case of loose, yielding soil, the bore has partly caved in. The fact that reversing from backward to forward movement is only possible in an absolutely pressureless state is particularly disadvantageous in soils containing water, as water and dirt quickly enter the machine when it has been turned off for reversing, and the machine will then not start up again. It is a further disadvantage that a reversing cord has to be pulled along behind which can easily get caught up and can then cause unintentional reversing or can break.

Finally, it is difficult to lock or unlock the control sleeve by means of the rope-operated rotation securing device by rotating the supply hose, particularly when the earth bore is already very deep.

OBJECT OF THE INVENTION

The object of the invention is to improve a ram boring machine of the kind mentioned in the introduction so that reversal under pressure is possible without remote controlled arresting means.

SUMMARY OF THE INVENTION

To this end, according to the invention, in a ram boring machine of the above-mentioned kind the control sleeve is loaded both axially and torsionally, has axial and rotational stops and is guided so that it can be rotated and axially displaced in a guide sleeVe arranged at the rear end of the housing. This enables the position of the control sleeve to be exactly defined in the locked and unlocked state. For reversing from forward to backward movement the control sleeve, which is arranged to have a limited extent of rotation in the guide sleeve, is rotated by means of the supply hose through a predetermined arc from one rotational stop to the other rotational stop and is thereby unlocked in the axial direction.

It is advantageous if a cylindrical helical spring, acting on the control sleeve, is held under torsional tension between the control sleeve and the guide sleeve so as not to rotate. By means of the cylindrical, helical spring, which is fastened by its ends in the control sleeve and in the guide sleeve under torsional tension, both the axial and the torsional pretensioning of the control sleeve can be ensured. The amount of the initial axial tension of the spring is such that when fully pressure-loaded the control sleeve overcomes the initial spring loading and is displaced backwards. After the control sleeve has met the axial stop that prevents further displacement the torsionally pretensioned spring rotates the control sleeve back into the locked position defined by a corresponding rotational stop.

To reverse from backward to forward movement the effective pressure is reduced until the initial axial spring tension is greater than the pressure acting on the control sleeve in the opposite direction. After being unlocked the control sleeve can thus be moved into the forward position by rotating the supply hose and there be brought back into the locked position by the initial torsional tension of the spring. The pressure can then be increased again.

A quarter-revolution of the compressed air hose is enough to change over to backward movement without having to turn off or reduce the pressure, so that the ram boring machine can be reversed under full power. It is true that when starting up on changing back to forward movement there is at first less pressure available if it has been reduced, but there is no longer the problem that the machine will not start up at all, as may be the case after a complete standstill.

A further advantage is that when reversing from backward to forward movement the air pressure in the ram boring machine is always high enough to prevent penetration of water or dirt into the ram boring machine, through the exhaust openings, as happens when the ram boring machine is at a standstill.

The control sleeve can advantageously be connected to the supply hose by way of a guide tube having two spaced peripheral grooves that form the axial stops and having a region of non-circular cross-section, and can have an opening with a cross-section that complements the non-circular cross-section of this region.

An elastic bush is advantageously arranged between the control sleeve and the guide tube. This enables the control sleeve to slide centrally and without jamming in the cylinder chamber of the striking piston, even if there should be manufacturing irregularities.

The rotational stops preferably comprise projections arranged in the peripheral grooves that cooperate with the non-circular opening in the guide sleeve. Thus the non-circular cross-section of the tube section can be formed by at least one flattened part in the circular cross-section. The projections can advantageously comprise at least one circular section having a radius reaching the flattened part and at least two straight surfaces spaced apart and extending tangentially from the circular section to the radius of the tube section.

A preferred embodiment is one in which the non-circular cross-section of the tube section comprises two parallel flattened parts and two projections with diametrically opposed circular sections and straight tangential surfaces adjoining them at an angle of about 90 degrees. In this embodiment it suffices to rotate the supply hose and thereby the control sleeve through 90 degrees to unlock the guide sleeve and displace it axially.

The axial and the torsional pretension of the cylindrical helical spring arranged between the control sleeve and the guide sleeve can be adjusted particularly easily if the ends of the cylindrical, helical spring are bent axially according to the invention and engage in pockets in the control sleeve and in the guide sleeve. A plurality of peripheral pockets can be arranged in the control sleeve and in the guide sleeve so that the end of the cylindrical, helical spring can be inserted into different pockets, thereby enabling the torsional pretension to be changed.

So that the cylindrical helical spring does not block the striking piston when the supply hose is rotated the helical spring can be wound, preferably as a volute, so that its diameter decreases with increasing torsional tension.

BRIEF DESCRIPTION OF THE DRAWINGS

The invention will now be described in more detail with reference to an exemplary embodiment shown in the drawings, in which.

DETAILED DESCRIPTION OF A PREFERRED EMBODIMENT OF THE INVENTION

Figure 1:
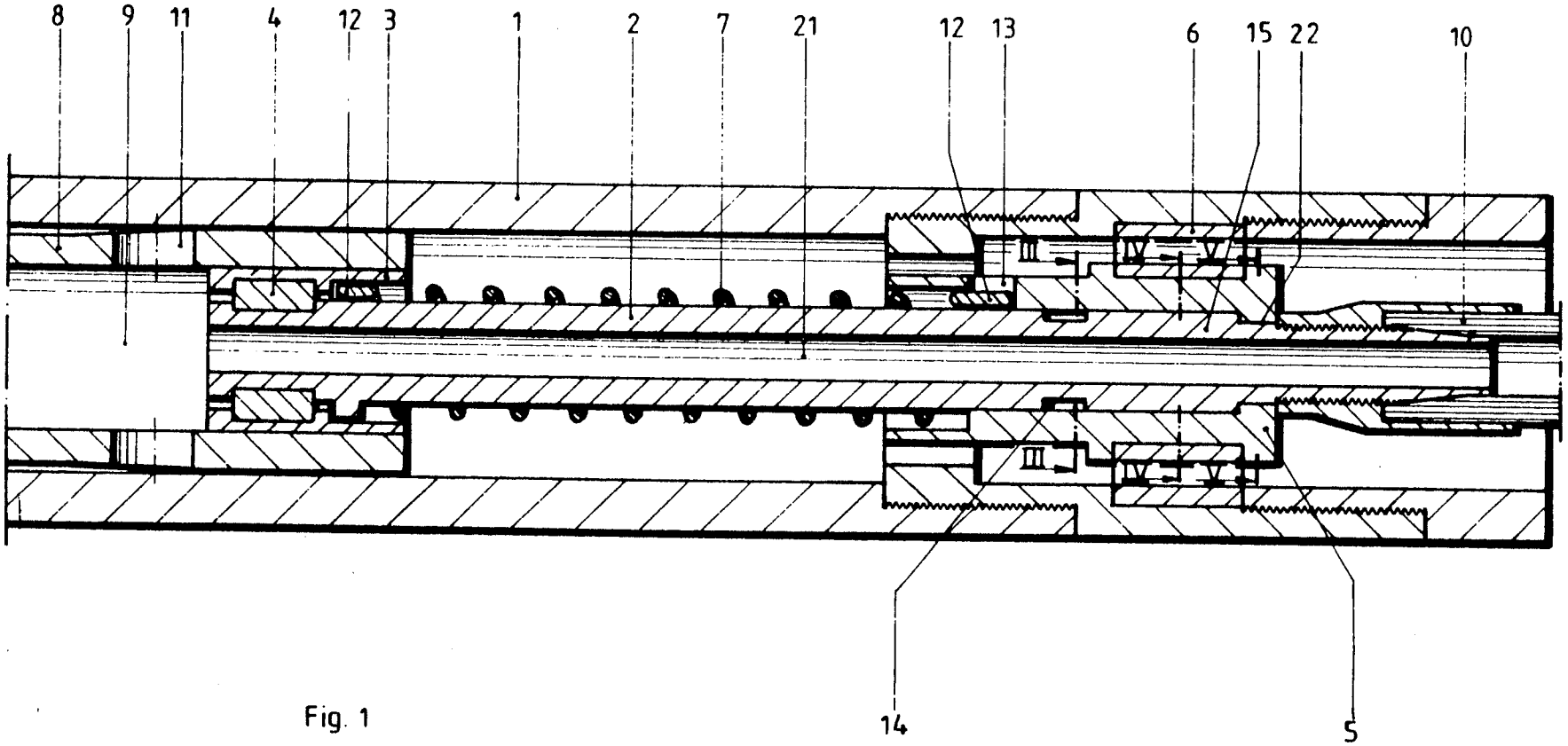
FIG. 1 shows a section of part of a ram boring machine with its control sleeve adjusted for forward movement.
Figure 2:
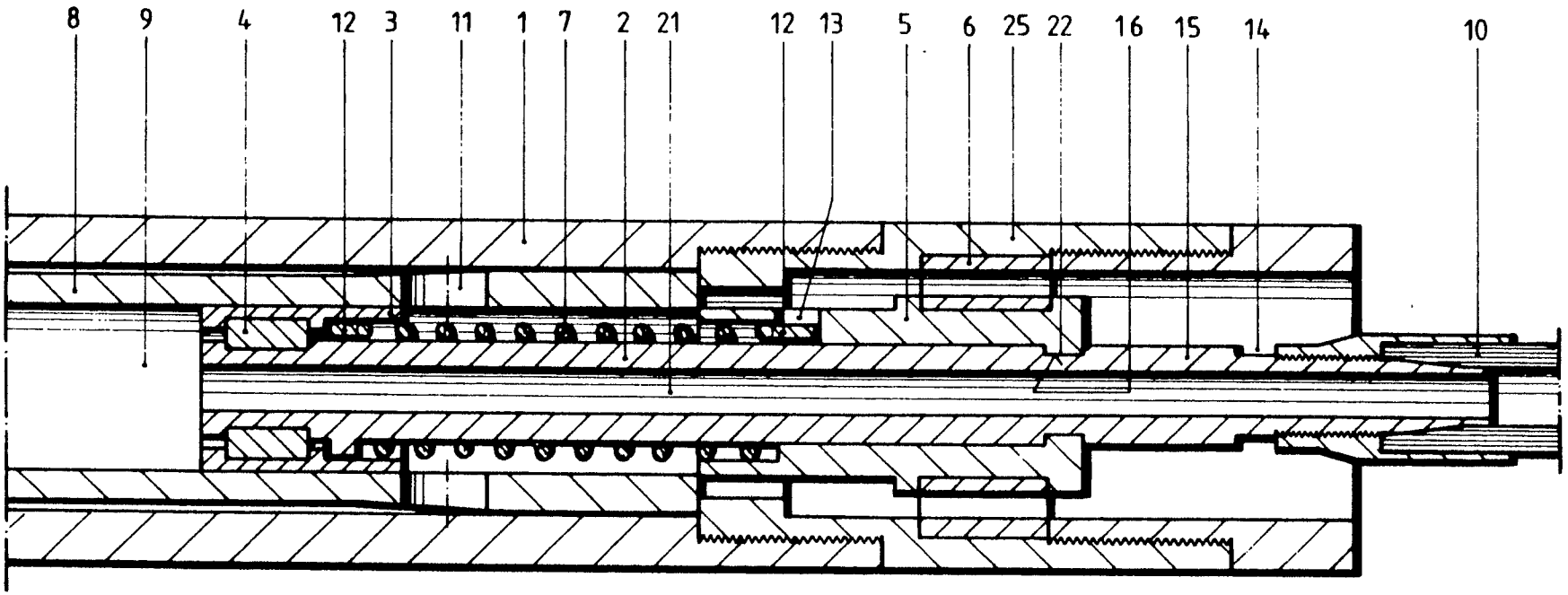
FIG. 2 shows a section of part of a ram boring machine with its control sleeve adjusted for backward movement.
Figure 5:
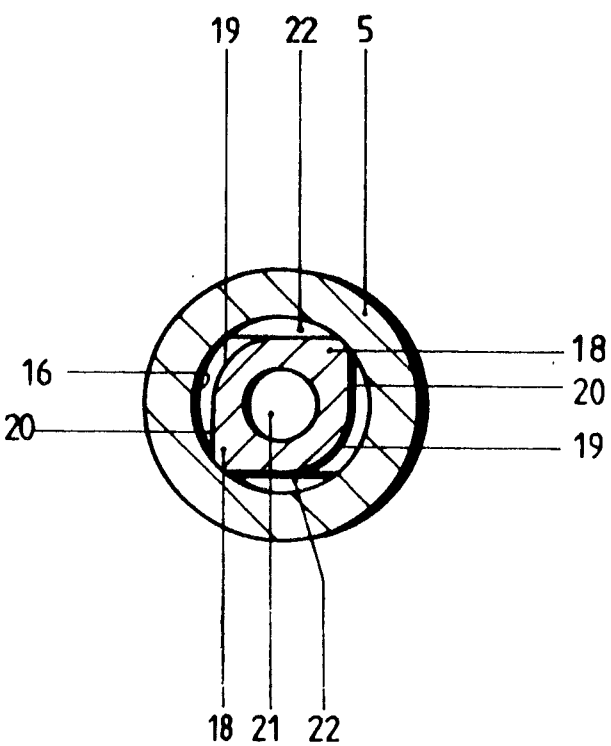
FIG. 5 shows the ram boring machine shown in FIG. 1 sectioned along the line V—V.
Figure 4:
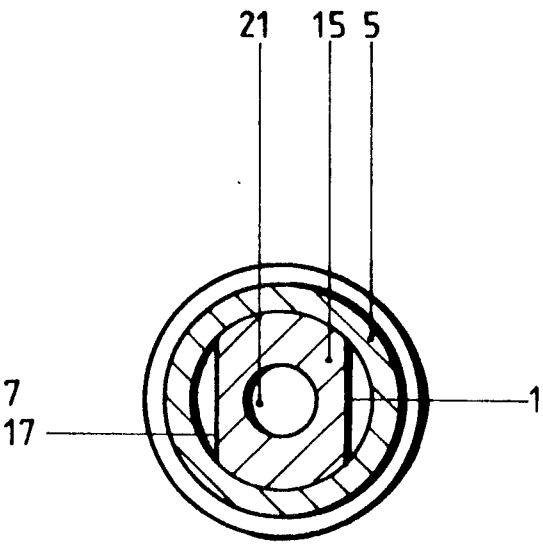
FIG. 4 shows the ram boring machine shown in FIG. 1 sectioned along the line IV—IV.
Figure 3:
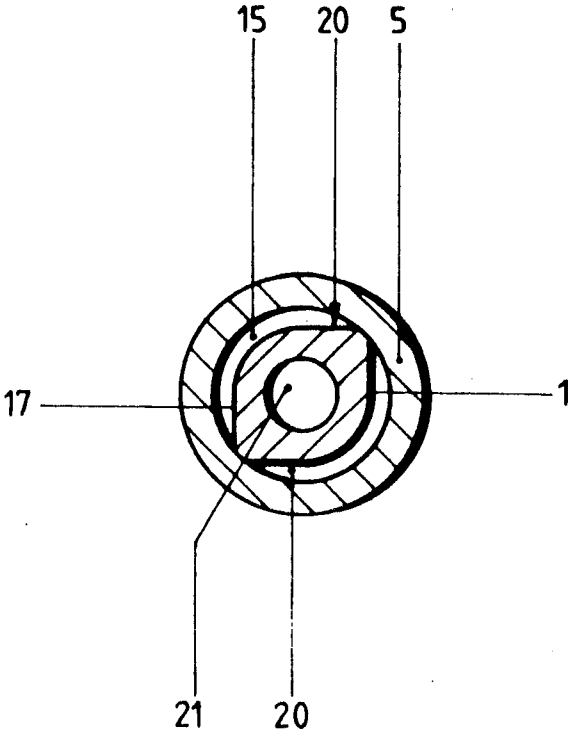
FIG. 3 shows the ram boring machine shown in FIG. 1 sectioned along the line III—III.

FIGS. 1 and 2 show only the rear end of a ram boring machine. The ram boring machine comprises a housing 1 in which a striking piston 8 moves back and forth. When moving forwards the head of the striking piston 8 strikes a pin of a striking tip projecting into the housing 1. A control sleeve 3 is arranged sealingly in a cylinder chamber 9 of the striking piston 8. The control sleeve 3 is connected by way of n elastic bush 4 to a guide tube 2, which for its part is mounted in a guide sleeve 5. The guide sleeve 5 is screwed to the rear end of the housing 1 by way of a connection 25 and is surrounded by a venting block 6 through which compressed air used for applying pressure escapes to the outside when the striking piston 8 has been moved so far back over the control sleeve 3 that its control openings 11 have passed beyond the control edges of the control sleeve 3. A supply hose 10, through which compressed air is supplied, is connected to the guide tube 2 so that it is pressure-tight and does not rotate.

A cylindrical, helical spring 7, which is under axial and torsional pretension, is arranged between the control sleeve 3 and the guide sleeve 5. For this purpose the ends 12 of the helical spring 7 are bent axially and secured against rotation in pockets 13 both in the control sleeve 3 and in the guide sleeve 5.

In the region of the rear end of the guide tube 2 there are spaced peripheral grooves acting as stops 14. Located between these peripheral grooves 14 is a tube section 15 of the guide tube 2 which has two parallel flattened parts 17. Arranged in the guide sleeve 5 surrounding the tube section 15 is a recess 16 that complements the cross-section of the tube section 15. The guide tube 2 can be axially displaced in the guide sleeve 5 when the tube section 15 with its flattened parts 17 is aligned correspondingly with the recess 16. To effect this the guide tube 2 can be rotated through 90 degrees between two rotational stops 18 formed as projections in the peripheral grooves 14. The rotational stops (projections) 18 comprise diametrically opposed circular sections 19 and tangential, straight surfaces 20 adjoining them which extend at an angle of 90 degrees to one another. These tangential straight surfaces 20 bear against the inner surfaces of ribs 22 in the recess 16; they allow the guide tube 2 to be rotated through 90 degrees in the guide sleeve 5.

Because of the torsional pretensioning of the cylindrical, helical spring 7 the guide tube 2 is rotated into a position in which the tube section 15 is turned through 90 degrees relative to the recess and abuts against the ribs 22. Axial displacement of the guide tube 2 with the control sleeve 3 is not possible in this position.

After the guide tube 2 has been rotated by means of the supply hose 10 through 90 degrees the non-circular tube section 15 is aligned with the corresponding complementary recess 16 and axial displacement is possible. If the guide tube 2 with the control sleeve 3 is in the position shown in FIG. 1 in which the full pressure of the pressure medium supplied via the supply hose 10 reaches the cylinder chamber 9 via the bore 21 in the guide tube 2, a pressure overcoming the tension of the cylindrical, helical spring 7 acts on the front surface of the control sleeve 3, and the control sleeve 3 with the guide tube 2 is moved back into the position shown in FIG. 2. The guide tube 2 is rotated into its locked position by the torsional pretension of the cylindrical, helical spring 7; in this position the path of movement of the striking piston 8 is displaced back so far that it no longer strikes the front end of the housing 1 with its head but instead strikes the connection 25, which effects backward movement.

To reverse the ram boring machine back to forward movement it suffices to reduce the pressure and to unlock the guide tube 2 by rotating it through 90 degrees. The axial pretension of the cylindrical, helical spring 7 is then sufficient to displace the guide tube 2 with the control sleeve 3 back into the position shown in FIG. 1.

What is claimed is:

1. A ram boring machine having a striking piston that is axially displaceable in a housing, backward and forward movement of the machine is controlled by a guide tube that is non-rotatably connected to a supply hose and which engages within a cylinder chamber in the striking piston and by at least one corresponding control opening, wherein the guide tube is loaded both axially and torsionally, has axial and rotational stops and is rotatable and axially displaceable in a guide sleeve arranged at the rear end of said housing.

2. A ram boring machine according to claim 1, wherein a cylindrical, helical spring acting on said control sleeve is held between said control sleeve and said guide sleeve under torsional pretension so as not to rotate.

3. A ram boring machine according to claim 1, wherein said control sleeve is connected to said supply hose by means of a guide tube having two spaced peripheral grooves forming the axial stops and a tube section with a non-circular cross-section, and said guide sleeve has an opening with a cross-section that complements the non-circular cross-section of said tube section.

4. A ram boring machine according to claim 3, wherein an elastic bush is arranged between said guide tube and said control sleeve.

5. A ram boring machine according to claim 3, wherein projections cooperating with said non-circular opening in said guide sleeVe are arranged in said peripheral grooves.

6. A ram boring machine according to claim 3, wherein said non-circular cross-section of said tube section comprises at least one flattened part in the circular cross-section.

7. A ram boring machine according to claim 5, wherein said projections comprise at least one circular section with a radius extending to said flattened part and at least two spaced straight surfaces extending tangentially from said circular section to the radius of said tube section.

8. A ram boring machine according to claim 7, wherein said non-circular cross-section of said tube section comprises two parallel flattened parts and two projections with diametrically opposed circular sections and tangential, straight surfaces adjoining said sections at an angle of about 90 degrees.

9. A ram boring machine according to claim 2, wherein the ends of said cylindrical, helical spring are bent axially and engage in pockets in said control sleeve and in said guide sleeve.

10. A ram boring machine according to claim 2, wherein said cylindrical spring is formed as a volute spring.

* * * * *